United States Patent [19]

VanHooser

[11] Patent Number: 4,715,794

[45] Date of Patent: Dec. 29, 1987

[54] BOTTOM-HOLE PUMP FLUID FLOW CONTROLLER

[76] Inventor: Neal E. VanHooser, Rte. 3, Box 140-A, Pauls Valley, Okla. 73075

[21] Appl. No.: 912,873

[22] Filed: Sep. 29, 1986

[51] Int. Cl.[4] ..... F04B 21/02

[52] U.S. Cl. ..... 417/313; 166/105.5; 417/572

[58] Field of Search ..... 417/448, 449, 450, 451, 417/452, 453, 313, 572; 138/41, 44, 40; 166/105.5

[56] References Cited

U.S. PATENT DOCUMENTS

| | | | |
|---|---|---|---|
| Re. 22,384 | 10/1943 | Williams | 417/449 X |
| 216,064 | 6/1879 | Spencer | 138/44 X |
| 1,476,444 | 12/1923 | Ellis | 417/449 |
| 1,621,046 | 3/1927 | Winsor | 417/448 |
| 1,957,007 | 5/1934 | Brandenberger | 417/451 |
| 2,095,899 | 10/1937 | Yancey | 138/44 X |
| 2,580,660 | 1/1952 | Crabtree | 417/449 X |
| 2,807,218 | 9/1957 | Hanlen | 417/449 |
| 3,114,327 | 12/1963 | Reynolds | 417/449 X |
| 3,483,827 | 12/1969 | Hooper | 166/105.5 |
| 3,510,234 | 5/1970 | Wolf | 417/450 |

FOREIGN PATENT DOCUMENTS

| | | | |
|---|---|---|---|
| 1170905 | 7/1984 | Canada | 417/448 |

*Primary Examiner*—Leonard E. Smith
*Attorney, Agent, or Firm*—Robert K. Rhea

[57] ABSTRACT

Oil produced by an oil well pump is increased by connecting a fluid flow controller, such as a choke nipple, with the fluid inlet end portion of an oil well pump. The controller serves to maintain a static head of fluid adjacent the pump inlet which permits expansion and dissipation of gas entering the pump fluid passageway thus substantially eliminating pump gas lock.

2 Claims, 1 Drawing Figure

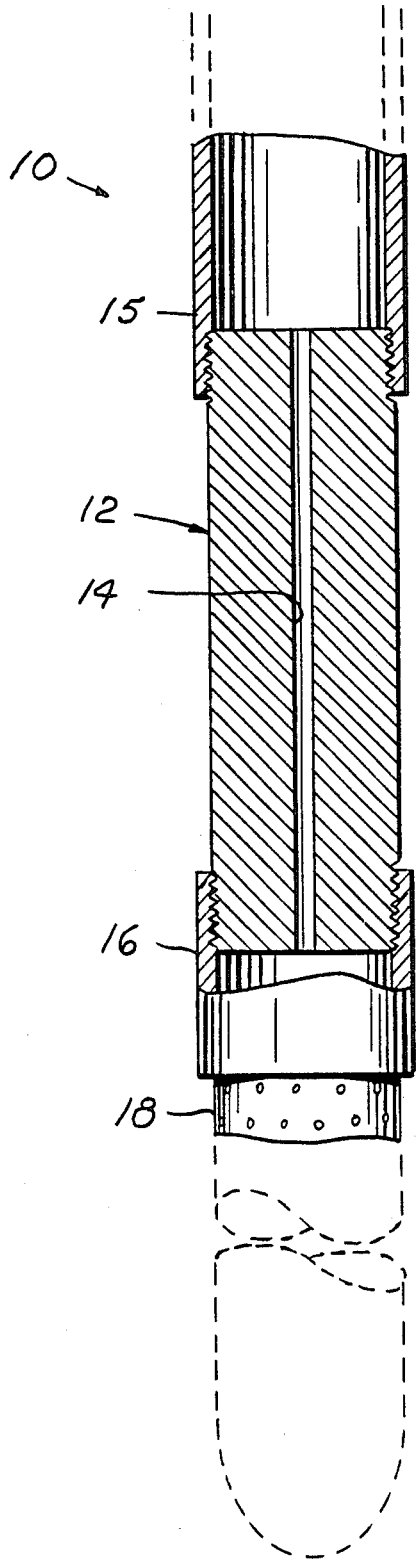
10
15
12
14
16
18

BOTTOM-HOLE PUMP FLUID FLOW CONTROLLER

BACKGROUND OF THE INVENTION

1. Field of the Invention

The present invention relates to sucker rod operated oil well pumps and more particularly to a pump liquid intake controller.

Pumping oil wells characteristically produce some natural gas which frequently results in a vapor lock in the pump. The gas lock or cavitation in the pump, in addition to disruptive effects on the pump components, such as erosion, pitting and fracturing of piping, results in economic loss as a result of reduced oil production. The cause of the gas lock is a pocket of gas trapped in the fluid passageway areas of the down-hole pump in which a static head of oil in the tubing above the pump tends to prevent dissipation of the gas and a resumption of oil production.

This invention substantially eliminates the gas lock problem of relatively small production pumping oil wells by inserting a restrictive member in the inlet section of a down-hole oil well pump.

2. Description of the Prior Art

Prior patents generally relate to tubular members having restrictive bore components inserted into the fluid passageway conveying liquid under relatively high pressure to provide a constant or steady flow of predetermined volume. Other restrictive members commonly used and generally known as "choke nipples" hold back the relatively high gas pressure for the production of oil at the well head.

SUMMARY OF THE INVENTION

In a conventional bottom-hole oil well pump, having a barrel or plunger vertically reciprocated by a string of sucker rods, a nipple of selected length and equal diameter with a depending tubular threaded end of the pump, is connected therewith. The nipple being centrally bored on a selected diameter in accordance with the pump capacity. The nipple or fluid controller functions to hold a head of fluid adjacent the intake of the pump allowing only a predetermined quantity of fluid to flow therethrough in a constant stream.

The principal object of this invention is to substantially eliminate cavitation in sucker rod operated oil well down-hole pumps by restricting the fluid flow into the pump to a predetermined volume.

BRIEF DESCRIPTION OF THE DRAWINGS

The single FIGURE is a vertical cross sectional view of the device interposed in an oil well pump intake end portion.

DESCRIPTION OF THE PREFERRED EMBODIMENTS

Like characters of reference designate like parts in those figures of the drawings in which they occur.

In the drawings:

The reference numeral 10 indicates the depending fluid inlet end portion of a conventional oil well bottom-hole pump supported by the depending end of a tubing string and having a working barrel or plunger reciprocated by sucker rods, neither being shown. The fluid controller 12 comprises an elongated cylindrical member externally threaded at both ends and having a relatively small diameter bore 14. The controller or nipple is axially connected to the depending tubular fluid inlet end 15 of the pump 10. A collar 16 connected with the depending end of the member 12 connects a perforated wall gas or sand anchor 18 to the member 12. By way of example the longitudinal dimension of the member 12 is not less than $2\frac{1}{2}$ times its diameter and not greater than $7\frac{1}{2}$ times its diameter. The diameter of the bore 14 is preferably 8/64 inches (6.35 mm).

As stated hereinabove the small diameter bore 14, by restricting the inlet of fluid to the pump in effect forms an expansion chamber in the bottom of the pump so that gas entering the pump with fluid may expand as a result of the pressure differential across the controller to minimize and substantially eliminate gas lock in the pump. A secondary benefit obtained by controlling the volume of gas is a reduction in scale build-up or accumulation in the pumping system fluid passageway.

Obviously the invention is susceptible to changes or alterations without defeating its practicability. Therefore, I do not wish to be confined to the preferred embodiment shown in the drawings and described herein.

I claim:

1. In an oil well bottom hole pump having a depending threaded tubular fluid inlet end portion for communicating with a fluid passageway through the pump, the improvement comprising:

fluid controller means including a cylindrical member having an 8/64 inch (6.35 mm) axial bore axially connected with said inlet end portion, the length of said member being not less than $2\frac{1}{2}$ times its diameter and not greater than $7\frac{1}{2}$ times its diameter.

2. The combination according to claim 1 and further including:

a sand anchor axially connected with the depending end of said member.

* * * * *